US005960374A

United States Patent [19]

Lausier

[11] Patent Number: 5,960,374

[45] Date of Patent: Sep. 28, 1999

[54] SYSTEM FOR TIME SYNCHRONOUS MONITORING OF PRODUCT QUALITY VARIABLE

[75] Inventor: Pierre P. Lausier, Mobile, Ala.

[73] Assignee: International Paper Company, Purchase, N.Y.

[21] Appl. No.: 08/800,866

[22] Filed: Feb. 14, 1997

[51] Int. Cl.[6] ..... G06F 19/00; D21F 11/00

[52] U.S. Cl. ..... 702/81; 364/471.03; 162/198

[58] Field of Search ..... 702/81; 364/468.15, 364/468.16, 468.17, 469.01, 471.01, 471.02, 471.03; 162/198, 252, 258, 263, DIG. 10, DIG. 11

[56] References Cited

U.S. PATENT DOCUMENTS

| | | | |
|---|---|---|---|
| 3,622,448 | 11/1971 | Adams et al. | 162/198 |
| 3,673,865 | 7/1972 | Michaelsen | 73/159 |
| 3,794,427 | 2/1974 | Shibata et al. | 365/120 |
| 3,840,302 | 10/1974 | Brunton et al. | 365/167 |
| 3,936,665 | 2/1976 | Donoghue | 235/151.3 |
| 3,989,085 | 11/1976 | Crosby | 162/198 |
| 4,019,066 | 4/1977 | Lucas et al. | 250/562 |
| 4,092,068 | 5/1978 | Lucas et al. | 356/73 |
| 4,152,202 | 5/1979 | DeLigt | 162/198 |
| 4,879,471 | 11/1989 | Dahlquist | 250/359.1 |
| 4,903,528 | 2/1990 | Balakrishnan et al. | 73/159 |
| 4,921,574 | 5/1990 | Hu | 162/198 |
| 4,947,684 | 8/1990 | Balakrishnan | 73/159 |
| 5,022,966 | 6/1991 | Hu | 162/198 |
| 5,121,332 | 6/1992 | Balakrishnan et al. | 364/471 |
| 5,122,963 | 6/1992 | Chen | 364/471 |
| 5,125,746 | 6/1992 | Lipshitz | 356/376 |
| 5,358,606 | 10/1994 | Makkonen | 162/198 |
| 5,400,258 | 3/1995 | He | 364/471.03 |
| 5,725,737 | 3/1998 | Pikulik et al. | 162/263 |
| 5,745,365 | 4/1998 | Parker | 364/469.01 |

*Primary Examiner*—Eric W. Stamber
*Attorney, Agent, or Firm*—Ostrager Chong Flaherty & Onofrio, P.C.

[57] ABSTRACT

A system for monitoring of a product quality variable of a moving web produced by associated equipment defines cross-direction (CD) data increments across a width of the web and machine direction (MD) data increments over a running length of the web, and takes CD/MD measurements of the selected variable in order to fill the corresponding CD/MD measurement data boxes and generate a time-dependent two-dimensional array mapping representing the moving web. In the preferred system, the CD data increments are divided across the width of the web, and the MD data increments are time-divided intervals of the time period of an element of the production equipment, so as to produce a time-synchronous array mapping which shows the impact of the periodicity of the machine element on the product quality variable.

9 Claims, 4 Drawing Sheets

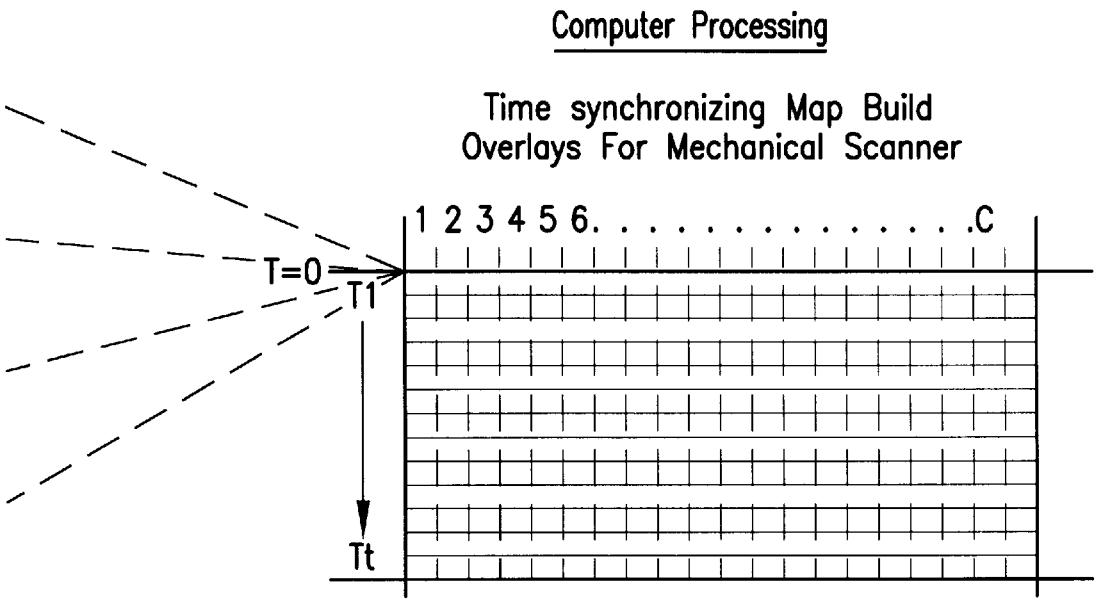
Appropriate MD and CD data boxes are populated based on the measurement position(s) during an MD time interval.
Data from each overlay is processed with data from prior overlays. Number of overlays determines the level of filtering of the map data.
Fig. (3ii)

Example Graphical Output

SYSTEM FOR TIME SYNCHRONOUS MONITORING OF PRODUCT QUALITY VARIABLE

TECHNICAL FIELD

This invention generally relates to a system for monitoring product quality variables in production processes and, more particularly, for taking on-line measurements and generating a time-synchronous array mapping of a moving web in production which can be used to assess the impact of the periodicity of machine elements.

BACKGROUND OF INVENTION

Prior computerized monitoring systems have utilized time synchronous averaging techniques to monitor the mechanical performance of machine equipment. A few applications have utilized on-line process sensors and time synchronous averaging techniques to correlate process variables occurring in the machine direction (MD) to equipment performance. However, such prior systems have not generally used multi-dimensional and time-synchronous mapping of production process variables to control or correlate to equipment or component performance.

In the field of on-line measurement of paper quality variables in paper production, conventional on-line techniques have used scanning sensors to take cross direction (CD) measurements of selected paper quality variables at intervals across the width of the moving paper web, however these do not provide information on variations occurring in the machine direction (MD). Prior paper quality monitoring techniques have not generally utilized real-time, on-line measurements of the running performance of paper machine elements, such as felt belts and rotating equipment, in order to assess their impact on paper quality.

Off-line measurements of paper quality variables generally take static or destructive tests of paper samples after a run. Such off-line measurements are difficult to correlate to real-time changes occurring in paper quality due to operational conditions in one or more machine components.

U.S. Pat. No. 5,358,606 to Makkonen proposes a system for recording on-line variations in paper characteristics along the run length (MD) of a paper web, recording the periodicities of motion or rotation of selected machine elements, and comparing any periodicity detected in an MD measurement with the periodicities of the machine elements in order to locate a possible fault in the operational condition of the machine elements. Sensors may be used to monitor web basis weight, thickness, smoothness, transmission, fiber orientation, permeability, water content, gloss, opacity, filler content, fluttering, etc. Synchronizing pick-ups are disposed on the machine elements to record their periodicities. A computer program detects when any periodicity in a measured variable correlates to the periodicity of a machine element, and reports a possible fault.

U.S. Pat. No. 5,400,258 to He discloses the use of an array of "bump" actuators across the width of a paper web and a CD profile analyzer to detect the resulting impacts in the CD zones and build an array of coefficients for accurately mapping the effects of an upstream variation with its downstream impact.

However, these proposed techniques only measure paper quality variables in one direction, i.e., either the MD or the CD, and do not show how the operational conditions of machine elements may have multi-dimensional or cross-correlated impacts over the entire paper web.

SUMMARY OF INVENTION

It is a principal object of the present invention to improve product quality monitoring by utilizing time-synchronous product variable measurements in a time-dependent, two-dimensional array encompassing a moving web-like product for making more accurate assessments of the operational condition of production equipment.

It is a specific object of the invention to provide a computerized system for on-line monitoring of the impact of moving or rotating parts of paper production equipment such as felt belts or calender rolls on paper variability and quality. Further objects include eliminating the requirement for costly physical sensor installations by creating virtual sensors utilizing time synchronous processing techniques, and eliminating unnecessary machine equipment replacements and machine downtime through effective real-time monitoring.

In accordance with the objects of the present invention, a system for monitoring of a product quality variable of a moving web produced by associated equipment comprises:

(a) computing means for defining cross-direction (CD) data increments across a width of the web extending in a cross direction and machine direction (MD) data increments over a running length of the web in a machine direction of time-dependent motion, so as to thereby define a time-dependent two-dimensional array of CD/MD measurement data boxes representing the moving web;

(b) measurement means for measuring a selected variable of the web on-line and providing corresponding CD/MD measurement data for each of the CD/MD measurement data boxes to said computing means for data retention and processing; and (c) said computing means further having mapping means for building and providing an output of a time-dependent two-dimensional mapping of the selected variable for the moving web based upon the CD/MD measurement data.

In a preferred embodiment, the system is used to assess the impact of the operational condition of an element of the production equipment on the selected product quality variable. For example, the system can be used to monitor variability in paper quality produced by a moving or rotating part such as a felt belt or calender roll in paper production. The impact of moving or rotating parts on a product web often correlates with their periodicity or cycles of movement. In the preferred system, the CD data increments are divided at intervals across the width of the web, and the MD data increments are time-divided intervals of the time period of an element of the production equipment.

By referencing the CD/MD measurement data boxes to the periodicity of the machine element, any variability produced by a periodic or cyclic condition of the machine element can be highlighted and other variability discounted. Current measurements for a measurement box may be time averaged with prior measurements for that box in order to filter out transient effects. When the impact of the operational condition of the machine element on the web has been assessed, the machine element can be adjusted, repaired, or replaced as needed, thereby avoiding unnecessary replacements or machine downtime.

Other objects, features, and advantages of the present invention will be explained in the following detailed description of the invention having reference to the appended drawings.

DETAILED DESCRIPTION OF INVENTION

Figure 1:
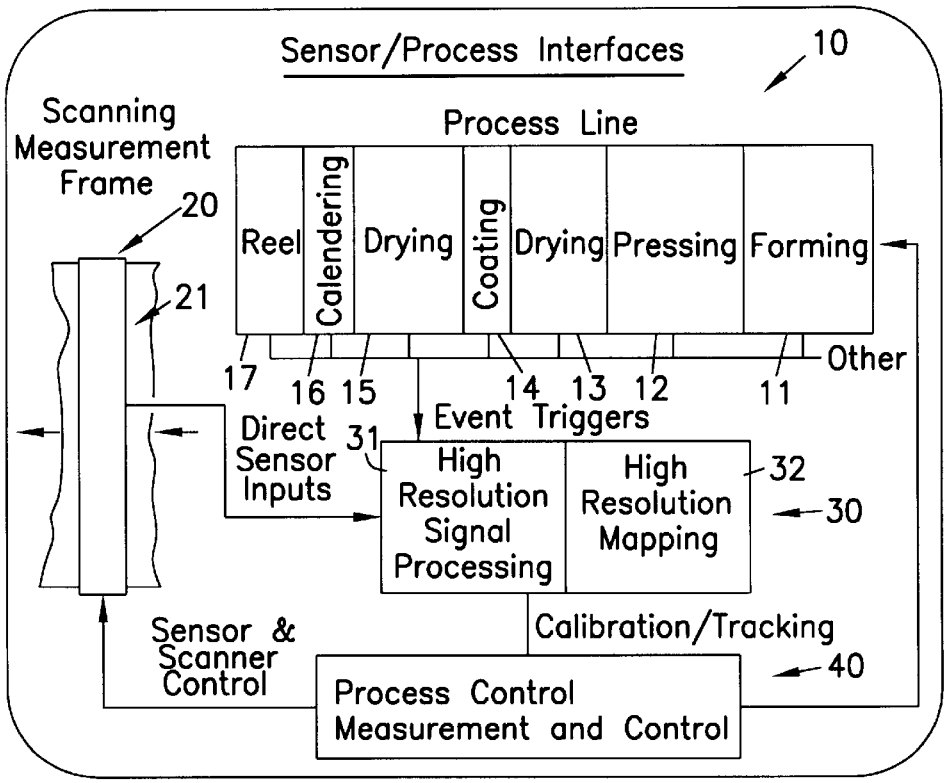
FIG. 1 shows the basic architecture of a product quality monitoring system according to the present invention applied to a paper process line.

For the present invention, FIG. 1 illustrates the overall architecture of a system for monitoring of a product quality variable as applied to paper production. A conventional paper process line 10 includes a paper web forming section 11, a pressing section 12, a drying section 13, a coating section 14, a secondary drying section 15, a calendering section 16, and a windup reel section 17. Sensors coupled to the machine elements are used to provide event trigger signals indicative of the operational condition of the element being monitored. As a preferred example, event trigger signals are provided to indicate the periodicity of one or more machine elements. Magnetic or photo-electric sensors may be used to detect the passage of a marker coupled to the machine element to demarcate each cycle or revolution of the element being monitored.

A scanning measurement frame 20 is mounted across the width a moving product web 21 and takes on-line measurements of a selected variable in the cross direction (CD) and machine direction (MD) of the web. The event trigger signals from the sensors coupled to elements of the process line 10 and the CD/MD measurement inputs from the scanning sensors of the measurement frame 20 are provided to a computer system 30, which has a high resolution signal processing front-end 31 and a high resolution mapping module 32.

A control loop provides calibration and/or tracking data from the mapping module 32 to a process and measurement control section 40 which is used to control the scanning sensors or scanning functions and/or the process line elements or their functions based upon analysis of the paper quality measurement data.

For a typical paper process line operating at speeds of 900 to 5,000 ft/min and producing a paper web of 12 to 30 feet in width, the web CD/MD measurements are preferably sampled at a rate greater than 150 samples/second. Each scanning measurement is identified with a machine direction (MD) and cross direction (CD) tag. The scanning device of the scanning measurement frame 20 may be mechanical, optical or electronic. The CD/MD measurement data captured by the signal processing front-end 31 are then processed into array maps of the selected paper quality variable by the mapping module 32 based on their MD and CD coordinate tags. The measurement data are digitally stored, so that they can be used for further digital processing. For example, the same measurement data may be associated with multiple maps, or combined with other measurement data to generate other maps. Multiple paper quality variable maps can be built simultaneously.

Scanning Operation

The scanning measurement frame 20 can have an array of sensors arranged in a row or rows across the width of the web 21, or a sensor device can be mechanically shuttled or optically scanned across the web from side to side continuously. Electronic scanning may be implemented in the form of web imaging, web flaw detection, and other electronic devices. Mechanical scanners are currently the primary source of multipoint sensor measurements on web lines, but are normally located downstream in the process line and in less hostile environments. A web line may have a number of scanners in order to obtain essential measurements at different critical points in the process line.

Figure 2:
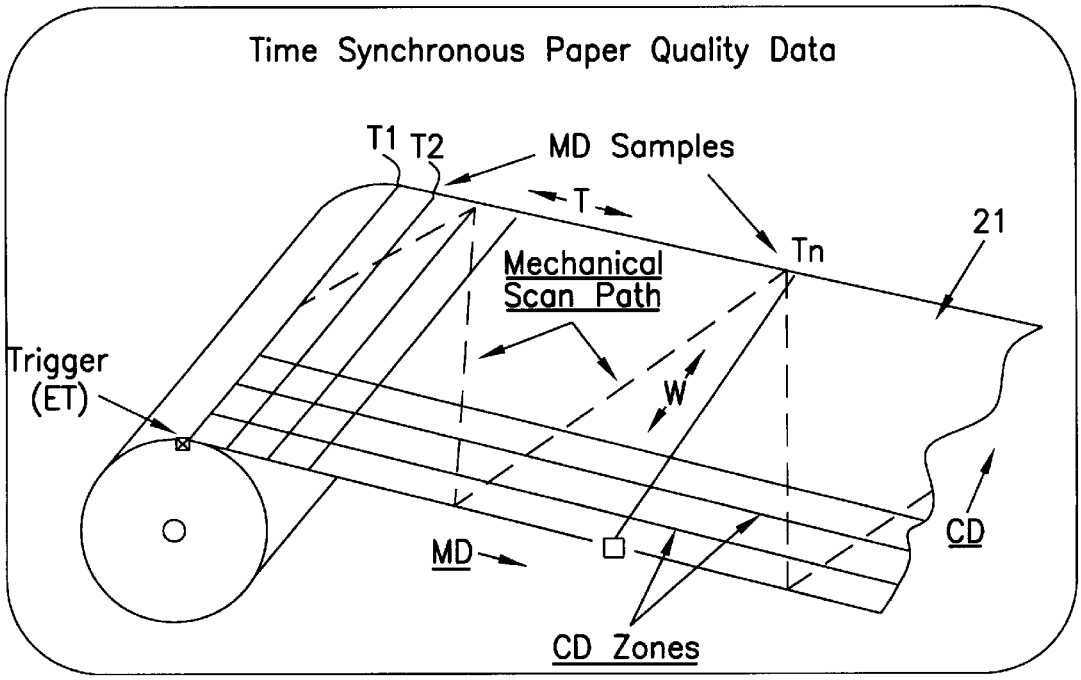
FIG. 2 illustrates the defining of CD and MD position increments for identification of the CD/MD measurement data boxes.

If the scanner uses a mechanically shuttled or traversed sensor, scanner position measurements must also be taken as they are essential to controlling the scanner within the physical limits of the web and to properly tagging the measurement data with accurate coordinates. Primarily, the cross direction (CD) profiles of the measurement data are generated with the use of the scanner position measurements. The CD coordinate is position based (spatial), i.e., it is preferably an increment of the width of the web. For example, as shown in FIG. 2, the width W of the web 21 can be divided into a plurlaity of CD zones. Measurements may be taken by a sensor array with elements positioned at the CD zone increments or, as shown in the figure, by scanning a sensor device from side-to-side across the mechanical scan path.

Conventional web line gauging technology has not generally factored in machine direction (MD) position measurement. In the preferred system, the MD position is selected as increments of running distance corresponding to an increment of the time periodicity of a machine element being monitored. Event triggers are mounted on each machine element being monitored, and are used to signal each detected cycle or complete rotation of the element. The time period of the element is divided into time increments which are used to define the MD position coordinates for the measurement data boxes.

Each MD data box is thus represented by an MD position at a time interval referenced from the event trigger signal. As illustrated in FIG. 2, the running length of the web in the MD corresponding to the time period T defined by the trigger ET is divided into time increments T1, T2, . . . Tn. For example, for a roller with a rotational period of one second and a running speed of the web of 50 feet/second, a 50-foot MD length of web can be represented by 100 MD data boxes at position intervals of 0.5 foot (time intervals of 0.01 seconds). The spatial CD zone increments and the MD position/time increments together define the data measurement boxes into which the scanned measurements of paper quality variable over the surface of the web are filled.

The CD/MD measurement data boxes provide the data elements from which an array mapping of the paper quality variable referenced to the MD and CD coordinates can be built. By continuously referencing the MD coordinates to an event periodicity trigger associated with a machine element being monitored, any product variability associated with that periodic element will be highlighted in the array mapping and other variability will be rejected. This time synchronization of the array mapping provides a powerful tool for identification of the impact of periodicity of process line elements on the web.

The techniques used to compile MD data from mechanical scanning devices can be similarly applied to electronic scanners, like camera technology, where a scan time in micro seconds is typical. The MD data boxes are generated based on the period of the machine element being monitored. Electronic scanners are capable of producing finer MD resolution, however, the techniques used to process the measurement data are similar to the techniques employed for mechanical scanners.

Figure 3I:
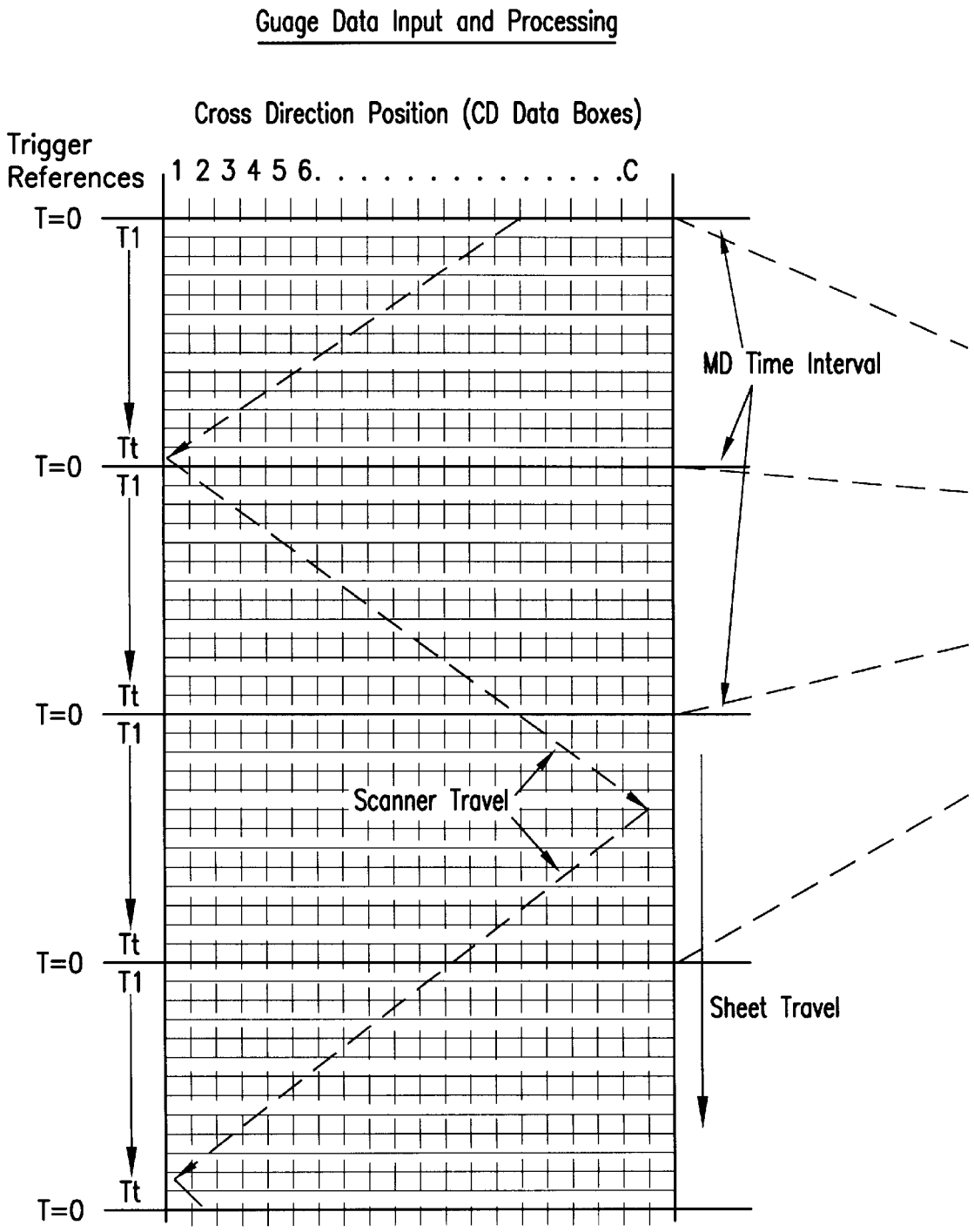
FIG. 3 illustrates an example of gauge scanning in which successive overlays of a scanner travel path are used to fill the CD/MD data boxes for an array mapping.

For reasons of lowered cost and simplification, it can be practical in many cases to build an array map of a given variable by mechanical scanning along a side-to-side scan path and filling in measurement data boxes over several scan cycles, hereinafter referred to as "gauge scanning". FIG. 3 illustrates an example of a map build using a series of scan overlays from a mechanical scanner. The time references T=0 are the event triggers associated with detection of the period of a machine element. The scanner travel path is synchronized to the time period T such that each traverse in a period fills in a different series of data boxes during computer processing. The appropriate CD/MD data boxes are populated based upon the CD/MD measurement positions during an MD time period interval T. The data filled in with each overlay are processed with data from prior overlays, until a complete array has been filled or suitably interpolated. The number of overlays required to fill the data box array determines the level of filtering of the map data, i.e., each map built reflects an averaging over the number of machine cycles spanned by the overlays. Gauge scanning is appropriate where the periodicity of the machine element repeats substantially the same in successive cycles.

Variability Maps

Measurement data are accumulated for the CD/MD data boxes into an array which has a defined map resolution. New data taken for an array location may be process with prior data for that array location in order to obtain a time-averaged value that is less sensitive to spikes and transients. The duration of a map build is determined by the number of scan overlays and number of data points accumulated into an array location during scanning. Map build times will vary depending on the resolution and precision of the desired map and computer processing capability.

Figure 4:
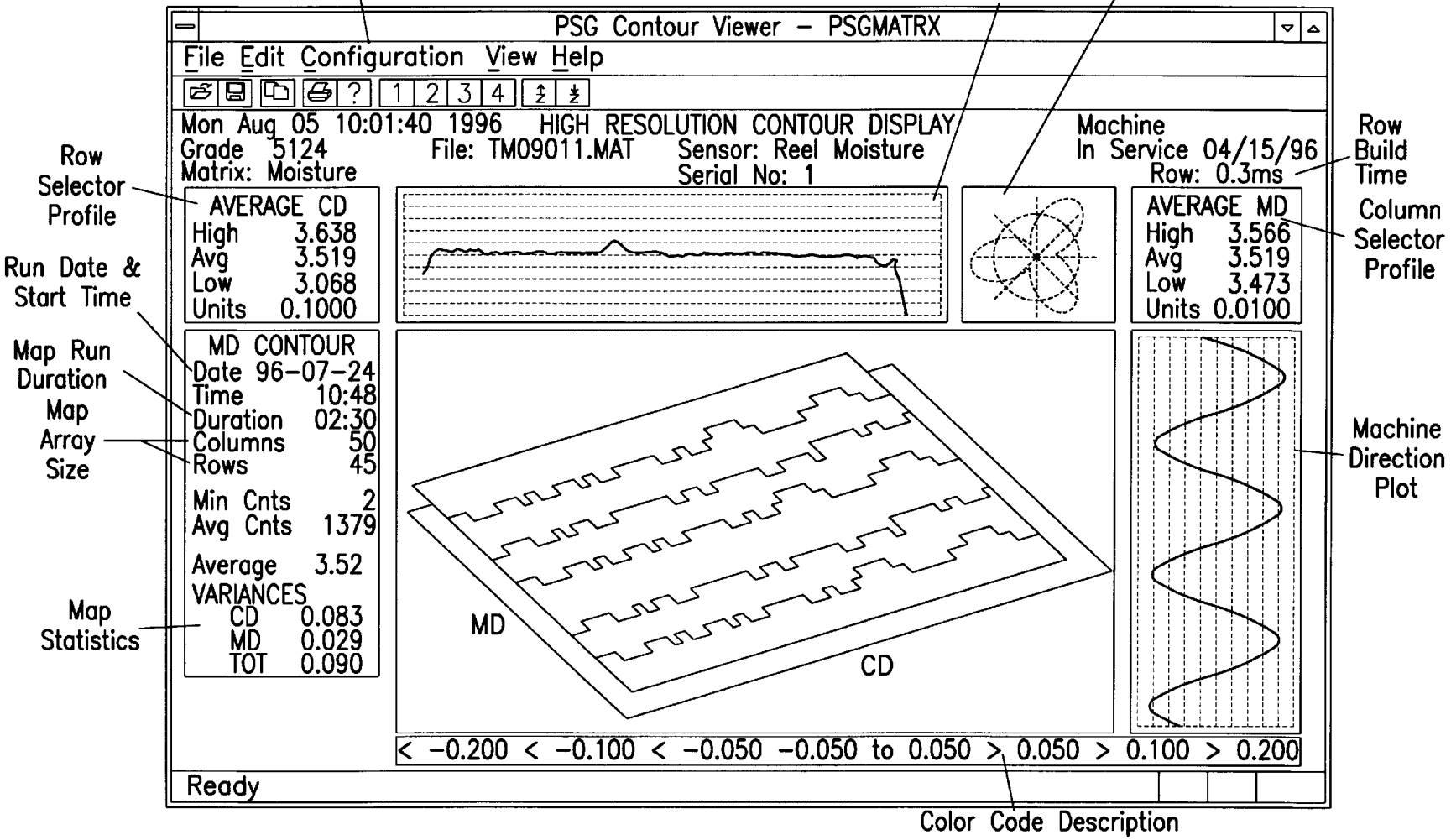
FIG. 4 shows an example of array mapping of a product quality variable in accordance with the invention as applied to reel moisture variability due to a bottom size press roll in paper production.

FIG. 4 shows an example of an array map generated from measurements of reel moisture in the web synchronized to the periodicity of a bottom size press roll in a paper process line. The output of the map shows moisture variability as measured on-line from the reel scanner, associated with one revolution of the bottom size press roll. Some of the control parameters provided in the graphical interface for the map build process are shown in the figure. The Map Setup Parameters are selected through a map configuration menu. The Cross Direction Plot graphs the measured variable values versus CD position. The Machine Direction Plot graphs the angular position of the periodic element versus MD time position. The Radar Plot illustrates a value profile at a given CD position of the press roll. The Map Array Size indicates that this example used 50 columns and 45 rows, and the Map Run Duration was two and a half hours. Other interface indicators include Row Build Time, Column Selector Profile, Row Selector Profile, and Map Statistics.

Analysis of the variability map example as described above showed that the bottom size press roll was causing irregularities in reel moisture values over the surface of the web, which were visible in the array mapping and radar plots as a three-lobed fluctuation in each cycle. These fluctuations were verified as having been caused by corresponding surface irregularities in the roll after it was removed from the paper machine and measured.

The measurement and processing techniques employed herein are equally applicable to other types of continuous sheet production lines (steel, aluminum, extrusion, etc.) which can utilize on-line quality scanning measurement systems. Many types of mechanical scan gauging systems may be used for the on-machine measurements, as well as developing electronic and camera scanning technology. The application of high-resolution scanning technology for array map building has become feasible with the availability of low-cost high-powered computer processing capabilities which can render a high resolution output directly from the scanning sensors.

Another advantage of the invention is that the association of MD data to the periodicity of particular machine elements through time synchronous techniques allows a variability map to be focused on a selected machine element for a particular measured variable without the need of a dedicated sensor. A "virtual" sensor image can be produced for elements in machine locations where physical measurement systems would be impractical.

The approach in the present invention of time synchronous array mapping of product quality variables from a moving web may be used with a wide range of other applications, variables, and analysis techniques. A full exploration of the variety of methods that may be used to generate and interpret time-synchronous two-dimensional variability maps are beyond the scope of the present invention. It is expected that a diverse array of computational and analytical tools, such as numerical techniques and expert systems, may be utilized for inter- and intra-map interpretation.

Various other modifications and variations may be devised given the above description of the principles of the invention. It is intended that all such modifications and variations be considered as within the spirit and scope of this invention, as it is defined in the following claims.

I claim:

1. A system for monitoring of a product quality variable of a moving web produced on associated equipment having at least one moving element that moves with a time periodicity that may vary for successive cycles of movement of said at least one moving element in conjunction with the moving web, comprising:

(a) computing means for defining cross-direction (CD) data increments across a width of the moving web extending in a cross direction and machine direction (MD) data increments which correspond to divided increments of the time periodicity of a cycle of movement of the at least one moving element over a running length of the moving web in a machine direction of time-dependent motion, so as to thereby define a time-dependent two-dimensional array of CD/MD measurement data boxes representing the moving web;

(b) sensing means for detecting the variable time periodicity of a cycle of movement of the moving element and providing a signal thereof to said computing means, wherein said computing means defines the MD data increments for the MD measurement data boxes on the basis of the signal provided by said sensing means as detected for the moving element;

(c) measurement means for measuring a selected variable of the moving web on-line and providing corresponding CD/MD measurement data for each of the CD/MD measurement data boxes using the CD and MD data increments defined by said computing means, and providing the CD/MD measurement data to said computing means for data retention and processing; and (d) said computing means further having mapping means for building and providing an output of a time-dependent two-dimensional array mapping of the selected variable for the moving web based upon the CD/MD measurement data.

2. A product quality monitoring system according to claim 1, wherein said computing means defines the CD data increments as position increments of the width of the moving web.

3. A product quality monitoring system according to claim 1, wherein said computing means provides an output of a time-synchronous mapping of the selected variable for the moving web on the production equipment, in order to assess an impact of the periodicity of the moving element of the production equipment on the selected variable.

4. A product quality monitoring system according to claim 1, wherein said sensing means is positioned to detect each cycle of movement or rotation of the moving element of the production equipment and to provide an event trigger signal to said computing means which is used as a time period reference for defining the MD data increments.

5. A product quality monitoring system according to claim 4, wherein said computing means comprises a signal processing front end for receiving CD/MD measurements from said measurement means and event trigger signals from said sensing means, and a mapping section for generating a time-synchronous two-dimensional array mapping therefrom.

6. A product quality monitoring system according to claim 4 as applied to paper production, wherein said measurement means is a scan element for gauge scanning of a moving paper web, and said sensing means includes a trigger element mounted to a moving or rotating element of the paper production equipment and a detector for detecting the trigger element and providing an event trigger signal for each detected cycle of movement or rotation of the moving element of the production equipment.

7. A product quality monitoring system according to claim 1, wherein said measurement means comprises a mechanical scan element that is shuttled or scanned across the width of the moving web.

8. A product quality monitoring system according to claim 7, wherein said measurement means scans the moving web from side-to-side across the width of the moving web along a scan path to provide CD/MD measurements for a subset of CD/MD data boxes with each of a series of scan overlays, and said computing means accumulates a plurality of scan overlays to build the array mapping.

9. A product quality monitoring system according to claim 1, wherein said measurement means comprises an array of sensor elements arranged in a row across the width of the moving web at positions corresponding to the defined CD data increments.

* * * * *